US009856759B2

(12) United States Patent
Scheidig et al.

(10) Patent No.: US 9,856,759 B2
(45) Date of Patent: Jan. 2, 2018

(54) CAMSHAFT ADJUSTER

(71) Applicant: Schaeffler Technologies AG & Co. KG, Herzogenaurach (DE)

(72) Inventors: Gerhard Scheidig, Oberasbach (DE); Olaf Boese, Nuremberg (DE); Kie Heon Aum, Nuremburg (DE)

(73) Assignee: Schaeffler Technologies AG & Co. KG, Herzogenaurauch (DE)

( * ) Notice: Subject to any disclaimer, the term of this patent is extended or adjusted under 35 U.S.C. 154(b) by 149 days.

(21) Appl. No.: 14/430,827

(22) PCT Filed: Sep. 9, 2013

(86) PCT No.: PCT/EP2013/200162
§ 371 (c)(1),
(2) Date: Mar. 24, 2015

(87) PCT Pub. No.: WO2014/086344
PCT Pub. Date: Jun. 12, 2014

(65) Prior Publication Data

US 2016/0251985 A1 Sep. 1, 2016

(30) Foreign Application Priority Data

Dec. 7, 2012 (DE) ..... 10 2012 222 537

(51) Int. Cl.
*F01L 1/344* (2006.01)

(52) U.S. Cl.
CPC ..... *F01L 1/3442* (2013.01); *F01L 1/34409* (2013.01); *F01L 2001/34459* (2013.01);
(Continued)

(58) Field of Classification Search
CPC ..... F01L 1/34409; F01L 1/3442; F01L 2001/34459; F01L 2001/34463;
(Continued)

(56) References Cited

U.S. PATENT DOCUMENTS 6,523,511 B2 2/2003 Hase
8,281,756 B2 10/2012 Suzuki et al.
(Continued)

FOREIGN PATENT DOCUMENTS

CN 101818667 9/2010
DE 102005036707 2/2007
(Continued)

*Primary Examiner* — Mark Laurenzi
*Assistant Examiner* — Paul Thiede
(74) *Attorney, Agent, or Firm* — Davidson, Davidson & Kappel, LLC

(57) ABSTRACT

A camshaft adjuster has multiple locking guide slots and multiple locking pins spring-loaded in the direction of engagement with the locking guide slots and which, by varying assignment to the rotor and to the stator, are arranged relative to one another such that the rotor can, under the action of fluctuating torques, be automatically locked into the predetermined center position relative to the stator proceeding from a first early or late stop position by a successive engagement of the locking pins into the locking guide slots. The locking pins and the locking guide slots are arranged so that, in the event of a rotation of the rotor in the direction of the center locking position proceeding from the respective other second early or late stop position, the locking pins lock into the locking guide slots in the reverse sequence from different directions.

11 Claims, 8 Drawing Sheets

(52) U.S. Cl.
CPC ..... *F01L 2001/34463* (2013.01); *F01L 2001/34466* (2013.01); *F01L 2001/34469* (2013.01); *F01L 2250/02* (2013.01)

(58) Field of Classification Search
CPC ... F01L 2001/34466; F01L 2001/34469; F01L 2250/02
USPC ..... 123/90.15, 90.16
See application file for complete search history.

(56) References Cited

U.S. PATENT DOCUMENTS

| | | | | |
|---|---|---|---|---|
| 2008/0223322 | A1 | 9/2008 | Stubbemann | |
| 2010/0037841 | A1 | 2/2010 | Strauss | |
| 2011/0067657 | A1 | 3/2011 | Strauss | |
| 2011/0088645 | A1 | 4/2011 | Yamaguchi | |
| 2011/0162601 | A1 | 7/2011 | Fujiyoshi | |
| 2012/0017858 | A1* | 1/2012 | Yokoyama ..... | F01L 1/022 123/90.15 |

FOREIGN PATENT DOCUMENTS

| | | |
|---|---|---|
| DE | 102007007072 | 8/2008 |
| DE | 102007028187 | 12/2008 |
| DE | 102008011915 | 9/2009 |
| DE | 102008011916 | 9/2009 |
| EP | 1452700 | 9/2004 |
| EP | 2224105 | 9/2010 |
| EP | 2 418 360 | 2/2012 |
| EP | 2 472 074 | 7/2012 |
| EP | 2 500 531 | 9/2012 |
| EP | 2 508 723 | 10/2012 |
| FR | 2814496 | 3/2002 |
| JP | 2001227311 | 8/2001 |

* cited by examiner

CAMSHAFT ADJUSTER

The present invention relates to a camshaft adjuster.

BACKGROUND

Camshaft adjusters are generally used in valve train assemblies of internal combustion engines to vary the valve opening and closing times, whereby the consumption values of the internal combustion engine and the operating behavior in general may be improved.

One specific embodiment of the camshaft adjuster, which has been proven and tested in practice, includes a vane adjuster having a stator and a rotor, which delimit an annular space, which is divided into multiple working chambers by projections and vanes. A pressure medium may be optionally applied to the working chambers, which is supplied to the working chambers on one side of the vanes of the rotor from a pressure medium reservoir in a pressure medium circuit via a pressure medium pump, and which is fed back into the pressure medium reservoir from the working chambers on the particular other side of the vanes. The control of the pressure medium flow, and thus the adjusting movement of the camshaft adjusting device, takes place, e.g., with the aid of a central valve having an complex structure of flow-through openings and control edges, and a valve body, which is movable within the central valve and which closes or unblocks the flow-through openings as a function of its position.

One problem with camshaft adjusters of this type is that the camshaft adjuster is not yet completely filled with pressure medium in a start phase or may even have been emptied, so that, due to the alternating torques applied by the camshaft, the rotor may execute uncontrolled movements relative to the stator, which may result in increased wear and an undesirable noise development. To avoid this problem, it is known to provide a locking device between the rotor and the stator, which locks the rotor in a rotation angle position with respect to the stator which is favorable for startup when the internal combustion engine is turned off. In exceptional cases, for example if the internal combustion engine stalls, it is possible, however, that the locking device does not properly lock the rotor, and the camshaft adjuster must be operated with an unlocked rotor in the subsequent start phase. However, since some internal combustion engines have a very poor start behavior if the rotor is not locked in the central position, the rotor must then be automatically rotated into the central locking position and locked in the start phase.

Such an automatic rotation and locking of the rotor with respect to the stator are known, for example, from DE 10 2008 011 915 A1 and from DE 10 2005 011 916 A1. Both locking devices described therein include a plurality of spring-loaded locking pins, which successively lock into locking gates provided on the sealing cover of the stator when the rotor rotates and which each permit a rotation of the rotor in the direction of the central locking position before reaching the central locking position while blocking a rotation of the rotor in the opposite direction. After the internal combustion engine has warmed up and/or the camshaft adjuster has been completely filled with pressure medium, the locking pins are forced out of the locking gates, actuated by the pressure medium, so that the rotor is subsequently able to properly rotate with respect to the stator to adjust the rotation angle position of the camshaft.

One disadvantage of the approach described therein is that the automatic locking is always active only during a rotation of the rotor in one direction, i.e., the rotor is automatically locked only during a rotation from an "advance" or "retard" stop position in the direction of the central locking position. An automatic locking of the rotor from both "advance" and "retard" stop positions in the direction of the central locking position is not possible using the locking devices described therein.

SUMMARY OF THE INVENTION

It is an object of the present invention to provide a camshaft adjuster having an automatic locking device, which automatically locks the rotor in the central locking position during a rotation from both "advance" and "retard" stop positions.

The present invention provides that the locking pins and the locking gates are situated with respect to each other in such a way that the locking pins lock in the locking gates in reverse order from different directions during a rotation of the rotor from the particular other second "advance" or "retard" stop position in the direction of the central locking position. Due to the proposed approach, the same pair of locking gates and locking pins may be used for locking the rotor from both "advance" and "retard" stop positions. The approach according to the present invention is based on the fact that the locking gates and the locking pins only have to be shaped and situated with respect to each other in such a way that the locking pins lock into the locking gates from different directions during a rotation in both directions, so that the present invention may be implemented without additional costs compared to the prior art.

It is furthermore proposed that the locking gates are situated and shaped in such a way that the locking gate in which the first locking pin first locks or is locked during a rotation from a first "advance" or "retard" stop position is simultaneously the locking gate in which the last locking pin locks during a rotation of the rotor from the second "advance" or "retard" stop position into the central locking position. As a result, all locking gates used for locking the rotor from one "advance" or "retard" stop position are also used when locking the rotor from the other stop position, so that the number of necessary locking gates may be kept as small as possible with a predetermined number of locking steps.

It is furthermore proposed that the locking gate in which the first locking pin locks or is locked during a rotation of the rotor from the first or the second "advance" or "retard" stop position is shaped in such a way that the first locking pin locked therein comes to stop against the edge of the locking gate when the central locking position is reached and prevents the rotor from continuing to rotate in the same direction. The locking gate in which the first locking pin is locked thereby forms a stop surface and defines the predetermined central locking position in one direction due to the position of the edge side.

In this case, it is furthermore proposed that the locking gate in which the last locking pin locks during a rotation of the rotor from the first or second "advance" or "retard" stop position is situated and shaped in such a way that the locking pin locked therein blocks a rotation of the rotor counter to the preceding rotary motion. Due to the proposed refinement, the rotor is additionally blocked in the other direction of rotation after the last locking pin is locked, so that the rotor is unable to rotate from the central locking position in either the direction of the stop position "advance" or in the direction of the stop position "retard."

It is furthermore proposed that at least three pairs of locking gates and locking pins are provided, and the locking gates are formed by curved, ring segment-shaped recesses or indentations, and the distances between the two locking gates in which the first and the second locking pins lock during a rotation of the rotor from one of the "advance" or "retard" stop positions and the distances between the locking pins locking therein are identical in the circumferential direction. Due to the proposed shaping and arrangement of the locking gates and the locking pins, identical locking paths of the rotor result during the rotary motion from the two stop positions. This also results in the possibility of situating the rotor in two different positions in the stator, if permitted by the pressure medium lines and the vanes of the rotor.

It is furthermore proposed that the two locking gates in which the first and second locking pins lock during a rotation of the rotor from the "advance" or "retard" stop position are situated axisymmetrically to a middle axis. Due to the axisymmetrical arrangement of the locking gates and the locking pins, the locking action may be implemented from the two stop positions particularly easily and using identical rotation angles.

It is furthermore proposed that the base surface of the locking gates has at least one step in at least one edge section. Due to the steps, multiple stop surfaces may be created in one locking gate, against which the locking pins are stopped in a blocking manner in the direction of the central locking position in the locking steps following the first locking of the locking pin.

In this case, the width of the step in the circumferential direction should correspond to the rotation angle of the rotor, around which the latter is rotated with respect to the stator until the next locking pin locks into the adjacent locking gate. Due to the proposed dimensioning of the width of the step, the locking pin engaging with the locking gate may be used to block the rotor against reverse rotation also in the additional locking steps after the first locking action, in that the locking pin then rests against the shoulder created by the step.

The locking gates in which one of the locking pins first locks or is locked during a rotation of the rotor from the "advance" or "retard" stop position may have one or multiple steps only on the edge section of the base surface, against which the locking pin rests in the "advance" or "retard" stop position, and the locking gates in which the engaging locking pins lock after the locking action of the first locking pin have at least one step on both edge sections of the base surface facing the adjacent locking gates. Due to the proposed arrangement of the steps, the circumstance may be taken into account that the first engaging locking pins always approach the locking gate only from one edge side and are finally inserted, while the second and third locking pins, provided that a total of four pairs of locking pins and locking gates are used, also approach the locking gates from different directions and are finally inserted therein as a function of the stop position from which the rotor is rotated in the direction of the central locking position.

It is furthermore proposed that the locking gates in which the first locking pin is locked in the "advance" or "retard" stop position are shaped in the manner of a circular arc section, and the length of the circular arc of the locking gates is dimensioned in such a way that the locking pins guided therein are movable from the "advance" or "retard" stop position into the central locking position. The locking pins which already engage with the first locking gate in the stop position are thereby guided into the locking gate until reaching the central locking position. The length of the circular arc is the length of the indentation or recess in the circumferential direction, minus the diameter of the locking pin, and corresponds to the length of the arc around which the locking pin is moved relative to the locking gate when the rotor moves with respect to the stator from the "advance" or "retard" stop position.

BRIEF DESCRIPTION OF THE DRAWINGS

The present invention is explained in greater detail below on the basis of one preferred exemplary embodiment. Specifically.

DETAILED DESCRIPTION

Figure 1:
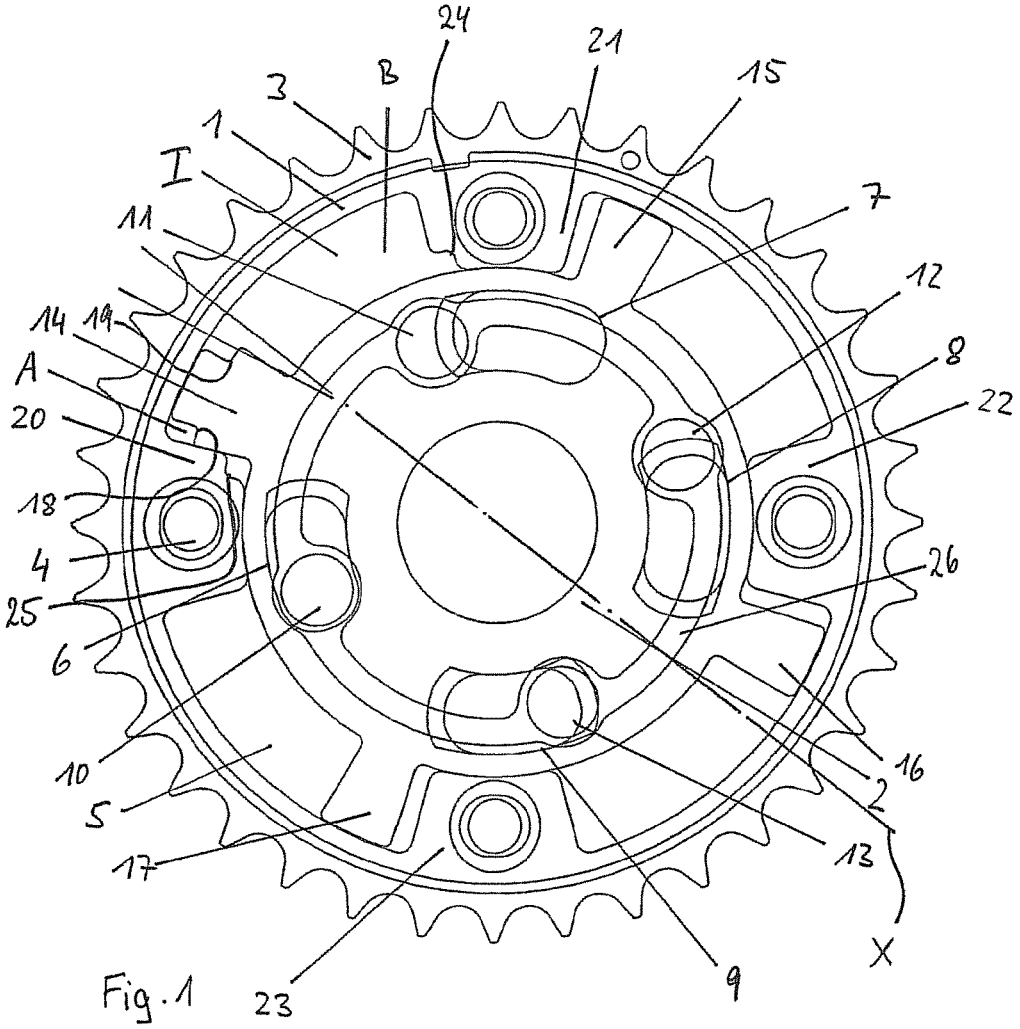
FIGS. 1, 2 and 3 show a camshaft adjuster, including a rotor in different locking positions, starting from the "retard" stop position in the direction of rotation toward the central locking position.

A camshaft adjuster of an internal combustion engine according to the present invention, including a stator 1 and a rotor 2, is apparent in FIG. 1. Stator 1 has a cup-shaped design and is provided with a toothing 3 on its outside for the purpose of being driven by a crankshaft via a chain or toothed belt. Rotor 2 is connectable to a camshaft in the known manner, e.g., via a central screw, and is driven to a rotary motion with the aid of stator 1. Stator 1 furthermore includes a plurality of stator webs 20, 21, 22, and 23, including threaded bores 4 situated therein, which divide an annular space provided between stator 1 and rotor 2 into multiple pressure chambers I. Rotor 2 includes a plurality of vanes 14, 15, 16 and 17, which extend radially outwardly to the inner wall of stator 1 and divide each pressure chamber I into two working chambers A and B. A translucently represented sealing cover 5 is furthermore provided, which is screwed into threaded bores 4 of stator 1 with the aid of fastening screws and which includes four locking gates 6, 7, 8 and 9. Four locking pins 10, 11, 12, 13 are also provided in rotor 2, which are spring-loaded in the engagement direction of locking gates 6, 7, 8 and 9 and to which pressure medium may be applied via a common pressure medium channel 26 for the purpose of unlocking from locking gates 6, 7, 8 and 9. During operation of the internal combustion engine, pressure chambers I are filled with pressure medium at least after a certain start phase, whereby the rotary motion of stator 1 is transmitted to rotor 2.

Locking gates 6, 7, 8 and 9 are ring segment-like or circular arc-shaped recesses or indentations in sealing cover 5, which are oriented and dimensioned in such a way that their center lines run on a common diameter.

Upper left vane 14 in the illustration is designed to be wider than remaining vanes 15, 16 and 17 and is used as a stop for rotor 2 for the purpose of limiting the rotary motion of rotor 2 with respect to stator 1 in the "advance" and "retard" stop positions. In order for rotor 2 to rotate into the provided stop positions in a preferably controlled manner without it being blocked in its rotary motion, e.g., by existing production radii, recesses 18 and 19 are provided on vane 14 on its outer edge sides extending into the illustration plane. For the same reasons, recesses 24 and 25 are provided on the two stator webs 20 and 21, which delimit pressure chamber I in which vane 14 is situated, on the radially inner edge sides extending into the illustration plane.

In the illustration in FIG. 1, rotor 2 is in the "retard" stop position, i.e., rotor 2 rests with vane 14 against the right side of stator web 20 delimiting pressure chamber I. In this position of rotor 2, working chamber A has the smallest volume and working chamber B to the right of vane 14 has the largest volume. In the event that the internal combustion engine is suddenly turned off in this position of rotor 2 or, e.g., if it suddenly shuts down due to stalling, problems may arise when the internal combustion engine is restarted, which are to be eliminated by the automatic reverse rotation of rotor 2, which is described below, into central locking position MVP apparent in FIG. 7. The alternating torques which act upon the camshaft when the camshaft adjuster is not yet completely filled with pressure medium, in connection with the design of locking gates 6, 7, 8 and 9, locking pins 10, 11, 12 and 13 proposed according to the present invention, are used for the automatic reverse rotation of rotor 2 into central locking position MVP as described below.

Figure 2:
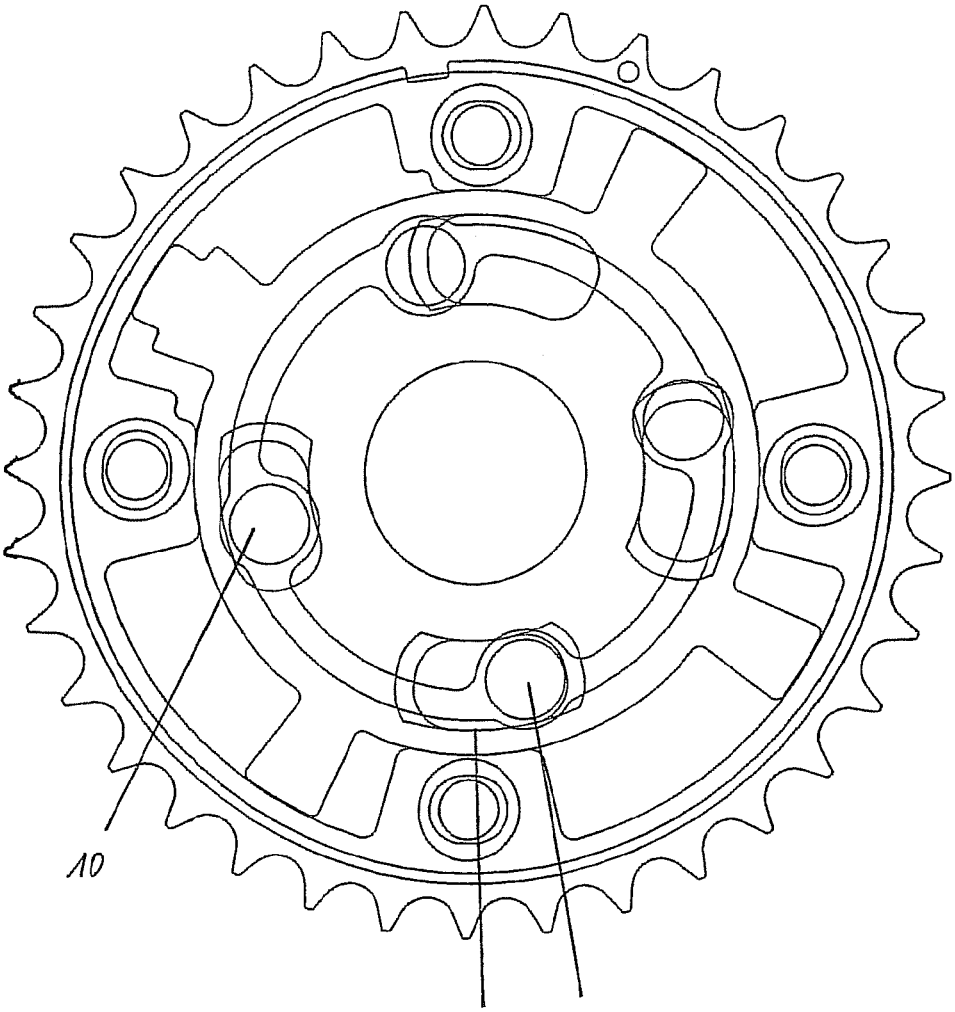
Figure 3:
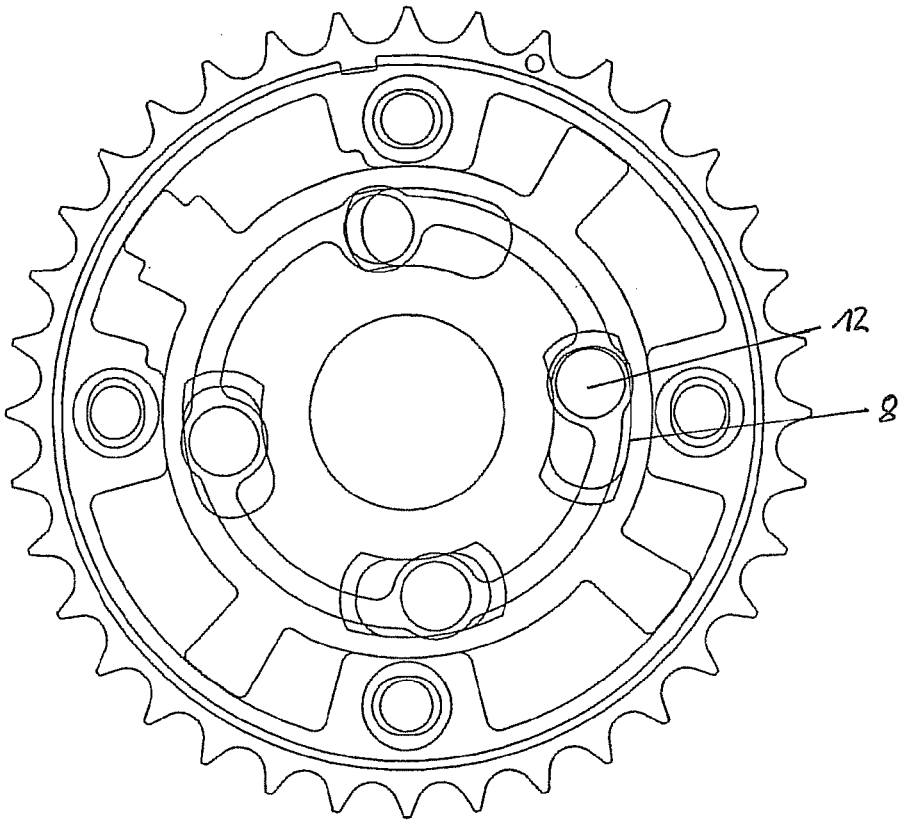

In the "retard" stop position illustrated in FIG. 1, first locking pin 10 already engages with locking gate 6, while the other locking pins 11, 12 and 13 still rest against the side wall of sealing cover 5 outside locking gates 7, 8 and 9. It is important that first locking pin 10 engages with locking gate 6 in such a way that rotor 2 is able to rotate relative to stator 1 at least clockwise in the direction of central locking position MVP. In the event that a torque acts upon rotor 2 in the clockwise direction in this position of rotor 2, rotor 2 is rotated clockwise with respect to stator 1 into the position in FIG. 2, in which second locking pin 13 locks into adjacent locking gate 9. If a subsequent torque occurs in the opposite direction, rotor 2 can no longer rotate back into the "retard" stop position. The next time a torque oriented in the clockwise direction acts upon the camshaft and thus on rotor 2, the latter continues to be rotated in the clockwise direction into the position illustrated in FIG. 3, in which second locking pin 13 locks into locking gate 9. Locking pin 10 is also moved into locking gate 6, so that it no longer rests against the radially oriented edge section of locking gate 6. The reverse rotation of rotor 2 back to the "retard" stop position is blocked in this position of rotor 2 by locking pin 13, which rests against the radial edge section of locking gate 9. During another rotation of rotor 2, locking pin 12 finally locks into locking gate 8 (see FIG. 3) in a next step, and last locking pin 11 finally locks into locking gate 7 in the central locking position MVP illustrated in FIG. 7.

Figure 7:
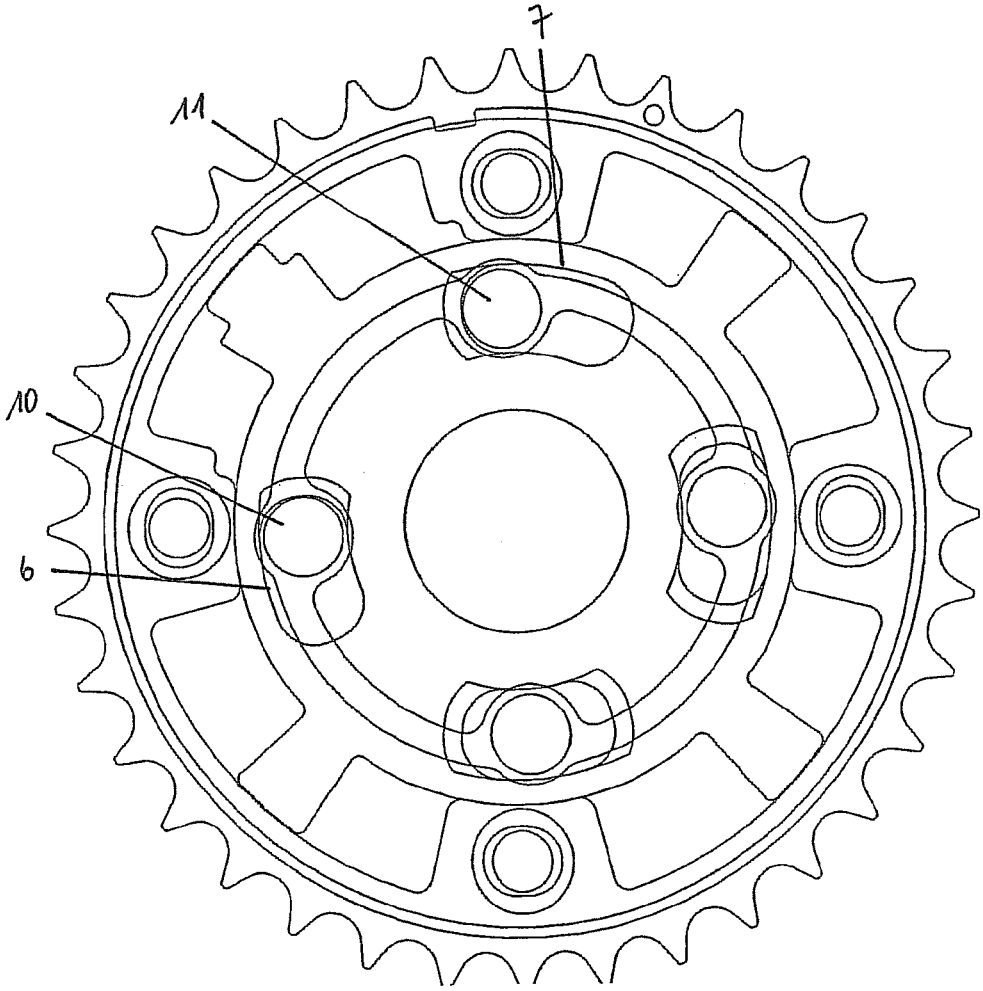
FIG. 7 shows a camshaft adjuster, including a rotor which is locked in the central locking position.

In central locking position MVP illustrated in FIG. 7, locking pins 10 and 11 rest against the radial edge sections of locking gates 6 and 7, so that rotor 2 is locked with respect to stator 1 in both directions of rotation.

Figure 4:
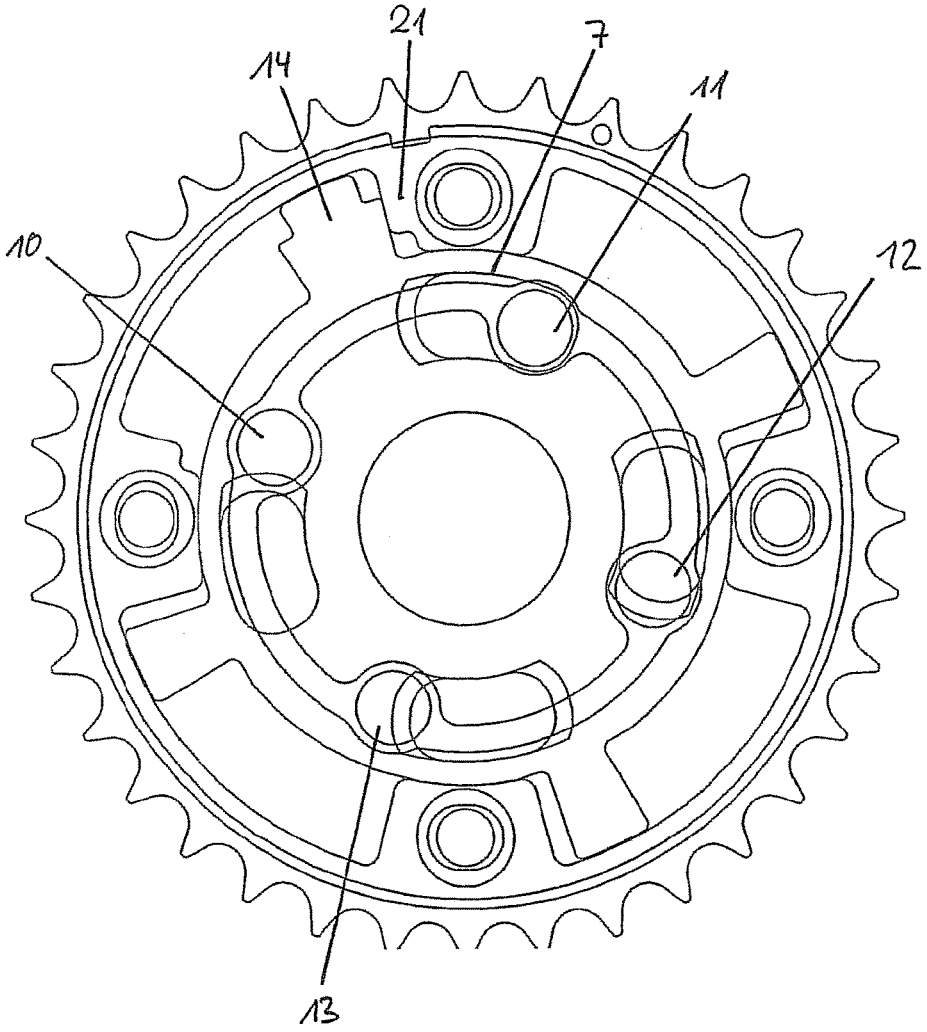
FIGS. 4, 5 and 6 show a camshaft adjuster, including a rotor in different locking positions, starting from the "advance" stop position in the direction of rotation toward the central locking position.
Figure 5:
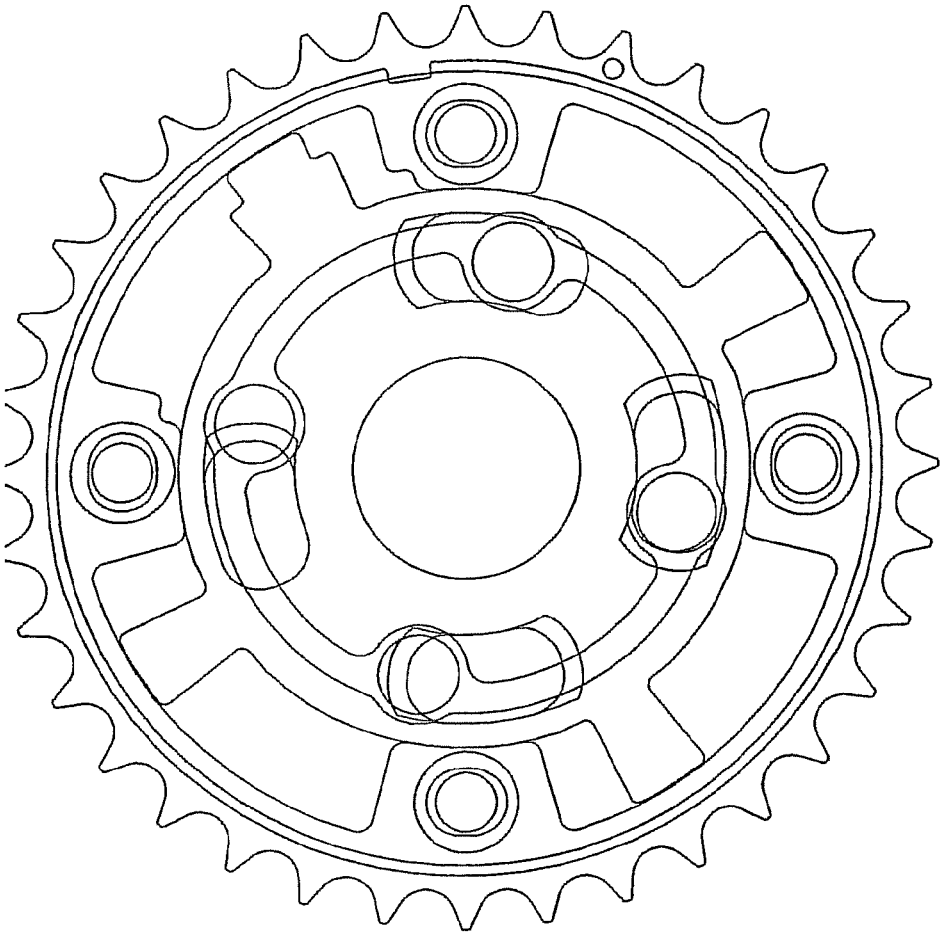
Figure 6:
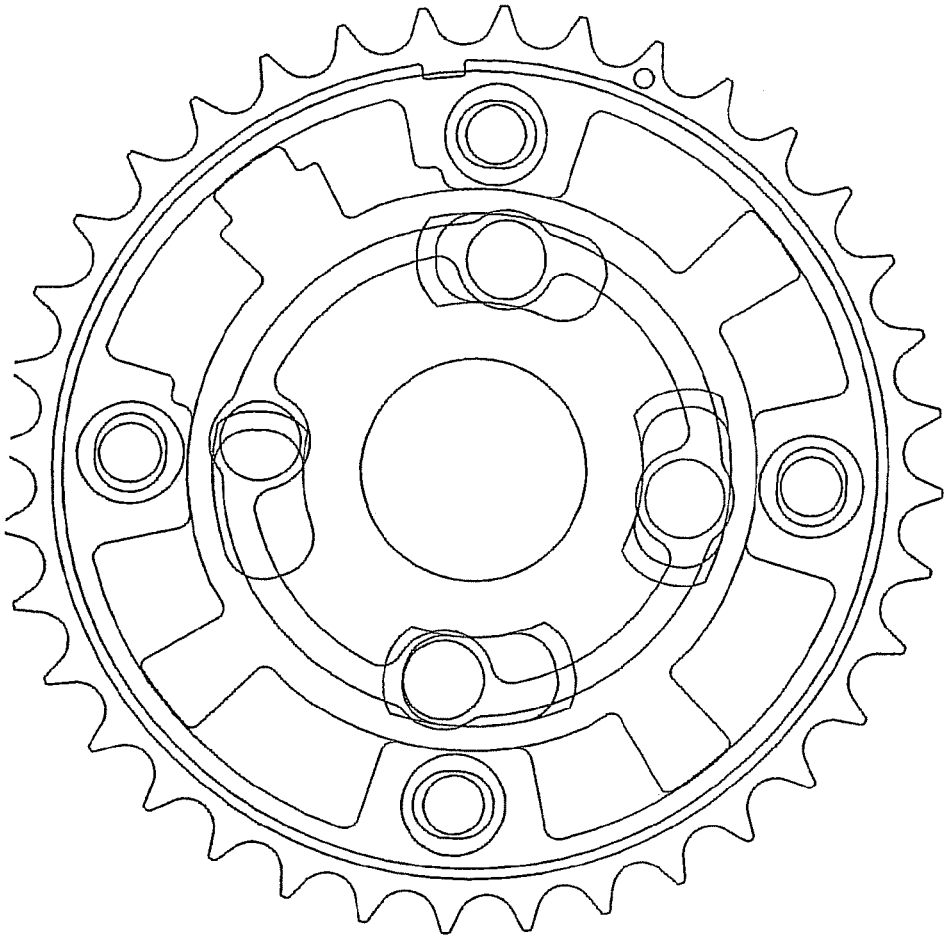

The same camshaft adjuster having rotor 2 situated in the "advance" stop position is apparent in FIG. 4, in which rotor 2 rests with vane 14 against stator web 21, which delimits pressure chamber I on the other side. Locking pin 11 is already locked into locking gate 7. If the internal combustion engine is started with the aid of a rotor 2 in this position, rotor 2 is gradually rotated counterclockwise into the position shown in FIG. 5 and FIG. 6, based on the same principle of the active alternating torques, locking pins 12 and 13 consecutively locking until last locking pin 10 finally locks into locking gate 6, and rotor 2 is blocked with respect to stator 1 in central locking position MVP illustrated in FIG. 7. The automatic reverse rotation of rotor 2 from the "advance" and "retard" stop positions is based on the same principle, with the difference that, during a rotation of rotor 2 from the "advance" stop position, locking pins 10, 11, 12 and 13 lock into locking gates 6, 7, 8 and 9 in the reverse order and from different directions than during a reverse rotation of rotor 2 from the "retard" stop position. The automatic reverse rotation of rotor 2 is thus implemented using the same locking pins 10, 11, 12, 13 and locking gates 6, 7, 8 and 9, so that no additional costs arise compared to the approach known from the prior art.

Figure 8:
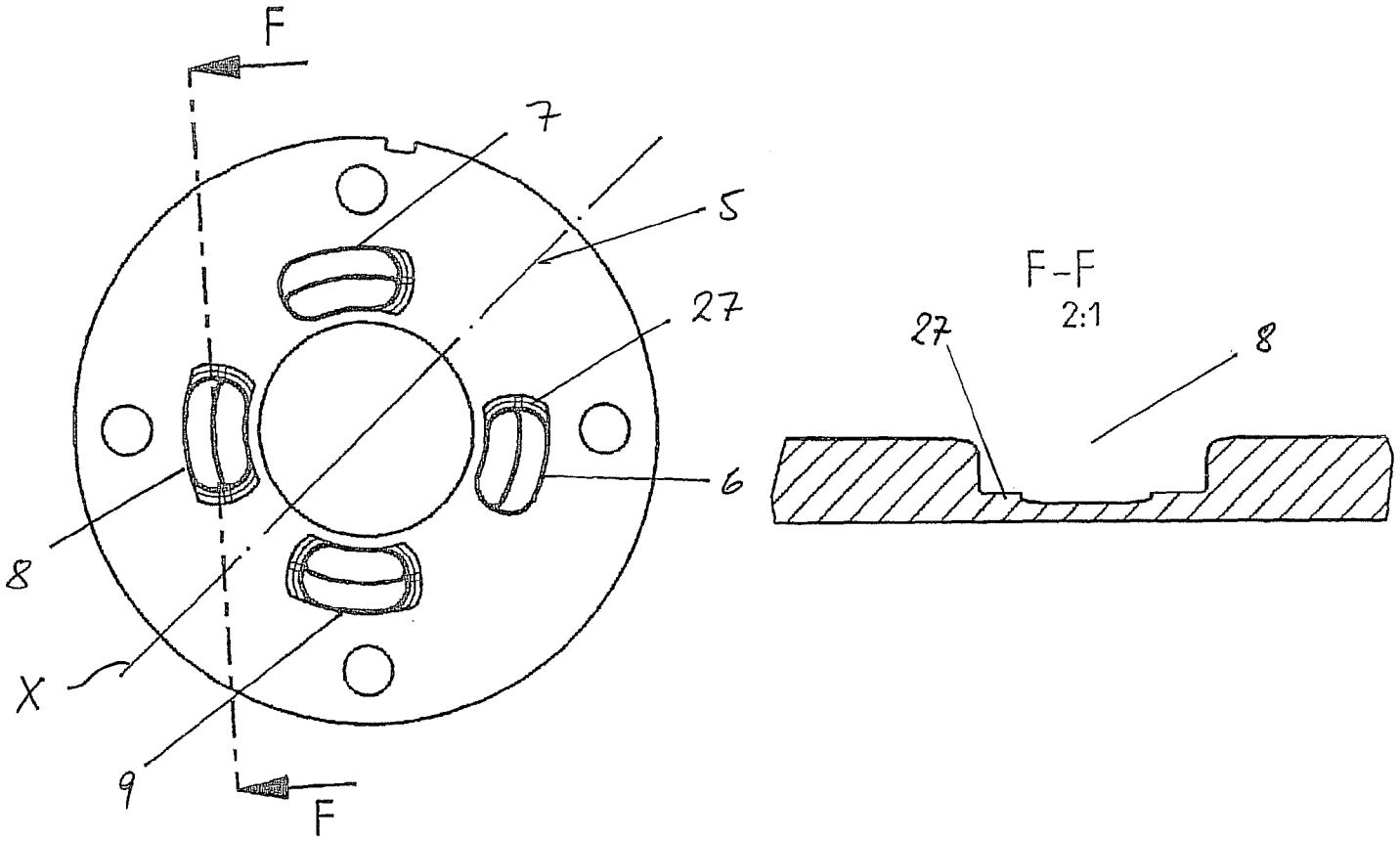
FIG. 8 shows a sealing cover or the base surface of the stator, including multiple locking gates, and a sectional representation of a locking gate.

FIG. 8 shows two locking gates 6, 7, 8, 9 in which the first and second locking pins 10, 11, 12, 13 lock during a rotation of the rotor 2 from the "advance" or "retard" stop position are situated axisymmetrically to a middle axis X.

Sealing cover 5, including locking gates 6, 7, 8 and 9, is apparent in FIG. 8. A sectional representation along section line F-F of locking gate 8 is shown in the illustration on the right. Locking gates 8 and 9, in which second or third locking pin 12 or 13 locks during a rotation of rotor 2 from the "advance" and "retard" stop positions, are each provided with steps 27 on their edge sections of the base surface oriented in the circumferential direction, while locking gates 6 and 7, into which first or last locking pin 10 or 11 locks, are provided with steps 27 only on their edge sections of the base surfaces facing each other. This is due to the fact that locking pins 10 and 11 always lock into locking gates 6 and 7 only from one side during the automatic reverse rotary motion, since one of locking pins 10 and 11 already engages with locking gate 6 or 7 in the "advance" and "retard" stop positions.

Steps 27 each form stop surfaces in the manner of a grid pattern, against which locking pins 10, 11, 12 and 13 rest in the circumferential direction in the intermediate positions between the "advance" and "retard" stop positions and central locking position MVP. As a result, the reverse rotation of rotor 2 is blocked in the direction of the "advance" and "retard" stop positions, and a continued rotation of rotor 2 in the direction of central locking position MVP is simultaneously facilitated.

LIST OF REFERENCE NUMERALS

1 stator
2 rotor
3 toothing
4 threaded bore
5 sealing cover
6 locking gate
7 locking gate
8 locking gate
9 locking gate
10 locking pin
11 locking pin
12 locking pin
13 locking pin
14 vane
15 vane
16 vane
17 vane
18 recess
19 recess
20 stator web
21 stator web
22 stator web
23 stator web
24 recess

25 recess
26 pressure medium channel
27 step

What is claimed is:

1. A camshaft adjuster comprising:

a stator and a rotor, the rotor being rotation angle adjustable in the stator between an advance stop position and a retard stop position, the rotor being actuated with the aid of a pressure medium;

a locking device for locking the rotor with respect to the stator in a predetermined central locking position between the advance and retard stop positions, the locking device including multiple locking gates and multiple locking pins each being spring-loaded in an engagement direction to a corresponding one of the locking gates and moved relative to each other during a rotation of the rotor with respect to the stator, due to a variable assignment to the rotor and the stator, and are situated with respect to each other in such a way that the rotor is lockable with respect to the stator by rotation of the rotor with respect to the stator when alternating torques act upon the camshaft, the rotor being lockable with respect to the stator from the advance stop position into the predetermined central locking position by the locking pins each engaging with the corresponding locking gate in a first successive order during a rotation of the rotor such that each locking pin locks with the corresponding locking gate at a different rotational position of the rotor with respect to the stator, and the rotor being lockable with respect to the stator from the retard stop position into the predetermined central locking position by the locking pins each locking in the corresponding locking gate in a second successive order that is reverse of the first successive order during a rotation of the rotor such that each locking pin locks in the corresponding locking gate at a different rotational position of the rotor with respect to the stator.

2. The camshaft adjuster as recited in claim 1 wherein the locking gates are situated and shaped in such a way that the locking gate in which a first of the locking pins first locks or is locked during a rotation from the one of the advance or retard stop position is also the locking gate in which a last of the locking pin locks during a rotation of the rotor from the other of the advance or retard stop position into the central locking position.

3. The camshaft adjuster as recited in claim 2 wherein the locking gate in which the first locking pin locks or is locked during a rotation of the rotor in a first direction from the advance or retard stop position is shaped in such a way that the first locking pin locked therein comes to stop against the edge of the locking gate when the central locking position is reached and prevents the rotor from continuing to rotate in the first direction.

4. The camshaft adjuster as recited in claim 3 wherein the locking gate in which the last locking pin locks or is locked during a rotation of the rotor from the advance or retard stop position is situated and shaped in such a way that the locking pin locked therein blocks a rotation of the rotor in a second direction counter to the first direction.

5. The camshaft adjuster as recited in claim 1 wherein the multiple locking gates include at least three locking gates and the multiple locking pins include at least three locking pins, each of the at least three locking gates being paired with one of the at least three locking pins, and the at least three locking gates are formed by curved, ring segment-shaped recesses or indentations, a first of the at least three locking pins locking in a first of the at least three locking gates and a second of the at least three locking pins locking in a second of the at least three locking gates during a rotation of the rotor from one of the advance or retard stop positions, a circumferential distance between the first and second locking gates being identical to a circumferential distance between the first and second locking pins.

6. The camshaft adjuster as recited in claim 1 wherein a first of the pins locks in a first of the locking gates and a second of the pins locks in a second of the locking gates during a rotation of the rotor from the advance or retard stop position, the first and second locking gates being axisymmetric to each other about a middle axis.

7. The camshaft adjuster as recited in claim 1 wherein a base surface of the locking gates has at least one step in at least one edge section.

8. The camshaft adjuster as recited in claim 7 wherein a width of the step in the circumferential direction corresponds to the rotation angle of the rotor around which the latter is rotated with respect to the stator until the next locking pin locks into the adjacent locking gate.

9. The camshaft adjuster as recited in claim 7 wherein the locking gates, in which one of the locking pins first locks or is locked during a rotation of the rotor from the advance or retard stop position have one or multiple steps only on the edge section of the base surface against which the locking pin rests in the advance or retard stop position.

10. The camshaft adjuster as recited in claim 1 wherein the locking gates, in which the engaging locking pins lock after the first locking pin is locked, have at least one step on both edge sections of the base surface facing the adjacent locking gates.

11. The camshaft adjuster as recited in claim 1 wherein the locking gate in which one of the locking pins is first locked in the advance stop position and the locking gate in which one of the locking pins is first locked in the retard stop position is shaped in the manner of a circular arc, and the length of the circular arc of the locking gates are dimensioned in such a way that the locking pins guided therein are movable from the advance or retard stop position into a central locking position in which rotor is locked with respect to stator in both directions of rotation.

* * * * *